United States Patent [19]

Blystone et al.

[11] 4,449,581

[45] May 22, 1984

[54] HEAT EXCHANGER FIN ELEMENT WITH DOG-BONE TYPE PATTERN OF CORRUGATIONS

[75] Inventors: Wayne G. Blystone; Gerald W. Lemmon, both of Mount Vernon, Ill.

[73] Assignee: Chromalloy American Corporation, St. Louis, Mo.

[21] Appl. No.: 413,246

[22] Filed: Aug. 30, 1982

[51] Int. Cl.[3] ..... F28F 1/32

[52] U.S. Cl. ..... 165/151

[58] Field of Search ..... 165/151

[56] References Cited

U.S. PATENT DOCUMENTS

| | | | |
|---|---|---|---|
| 1,927,325 | 9/1933 | Ritter | 165/151 |
| 3,437,134 | 4/1969 | Oddy | 165/151 |
| 3,916,989 | 11/1975 | Harada et al. | 165/151 |

FOREIGN PATENT DOCUMENTS

| | | | |
|---|---|---|---|
| 236342 | 11/1961 | Australia | 165/151 |
| 1105598 | 12/1955 | France | 165/151 |
| 2042708 | 9/1980 | United Kingdom | 165/151 |

*Primary Examiner*—Sheldon J. Richter

*Attorney, Agent, or Firm*—Haverstock, Garrett & Roberts

[57] ABSTRACT

An improved fin element adapted for use in a fin and tube type heat exchanger core assembly, the improved fin element having a plurality of tube openings extending therethrough and having a "dog-bone" type pattern of corrugations extending substantially over the entire planar surface thereof, the corrugated pattern forming a uniform, discontinuous, six-sided configuration about each respective tube opening for altering the fluid flow characteristics across the fin in such a manner as to enhance its heat transfer capability. The particular pattern of corrugations utilized on the subject fin element effectively induces turbulent flow thereacross; it causes circulation of the fluid medium flowing thereacross to the downstream side of the tubes extending therethrough; and, it effectively reduces the thickness of the boundary layer associated therewith to achieve increased heat transfer performance without a corresponding increase in fluid flow resistance.

7 Claims, 4 Drawing Figures

HEAT EXCHANGER FIN ELEMENT WITH DOG-BONE TYPE PATTERN OF CORRUGATIONS

The present invention relates to an improved heat exchanger fin construction adaptable for use in association with fin and tube type heat exchangers and, more particularly, to an improved fin element construction having a "dog-bone" type pattern of corrugations extending substantially over the entire plane surface thereof, the "dog-bone" pattern of corrugations altering the fin side fluid flow characteristics in such a manner as to enhance the heat transfer performance and overall efficiency of the heat exchanger unit utilizing these fins. Although the present fin elements are primarily designed for use in heat exchangers of the fin and tube type construction, the present fin devices are adaptable for use with any heat exchanger device which utilizes fins in its construction.

A wide variety of heat exchanger core constructions have been designed and manufactured for use as heat exchangers in a wide variety of applications such as for use in turbo-charged internal combustion engines and other aftercooler applications. The use of heat exchangers in an extremely wide range of industrial and commercial applications coupled with the highly desirable goals of energy conservation and fuel economy in all heat and energy related devices have resulted in a rapidly growing worldwide demand for the design of efficient, reliable, and economical heat exchanger equipment. Typical of such heat exchanger core constructions is the tube and fin type construction wherein heat transfer is effected between one fluid medium flowing through the tubes and a second fluid medium such as air flowing externally over the tubes through the flow passageways formed by and between the fin structures. In such a construction, a transfer of heat occurs directly between the fluid medium flowing within the tubes and the external fluid medium flowing over and around the tubes and the fins are provided to increase the effective heat transfer area therebetween. Typically, however, due to the separation of air flow as it passes around and between the respective tubes associated with a conventional tube and fin type core assembly, a stagnation area commonly develops adjacent the downstream side of each respective tube and this stagnation area produces a relatively low velocity region immediately downstream of each respective tube. This low velocity region results in a relatively thicker boundary layer on the fin and downstream tube surfaces and this greatly reduces the heat transfer capability of the fin since less air or other fluid flow comes directly into contact with the downstream sides of the tubes.

Since heat transfer from a fin surface is dependent upon the thickness of the boundary layer of the fluid medium flowing over the fin, the heat transfer capability of a fin can be improved by reducing the boundary layer thickness and, particularly, by reducing the thickness of the boundary layer on the downstream side of the tubes extending therethrough. In this regard, it is well known throughout the heat exchanger industry that various means are available for inducing turbulent air flow across fin surfaces thereby reducing the boundary layer thickness across such surfaces and, in effect, increasing the heat transfer capabilities of the overall units. Typical means for inducing such turbulent air flow across fin surfaces include adding ribs, louvres, dimples, and other disturbance devices to the normal plane surface of the fin for agitating the flow thereacross and directing at least a portion of the incoming air flow over and around the tubes extending therethrough. See for examples the fin constructions shown in U.S. Pat. Nos. 4,328,861; 3,515,207; 2,091,593; and 2,006,649. A penalty often incurred with these particular types of fin surface treatments is the undesirable increase in the resistance to fluid flow across the fin surface. This increase in fluid flow resistance may result in a reduction of the mass flow rate across the fin surface which will reduce the heat transfer capability of such fin structure. In addition, these configurations have generally been characterized as being unduly complex, as requiring structural elements in addition to the basic fin and tube structure, as requiring involved fabricating procedures, and/or as not effectively directing or influencing the fluid flow across the fin surface and around the tubes extending therethrough to achieve optimum heat transfer capability. For these and other reasons, the known means for inducing turbulent flow across a fin surface and increasing heat transfer efficiency have not been totally satisfactory.

The present heat exchanger fin construction overcomes many of the disadvantages and shortcomings associated with the known fin devices, and teaches the construction and operation of a relatively simple fin element having a "dog-bone" type pattern of corrugations extending substantially across the entire normal plane surface thereof for both inducing turbulent air flow thereacross and for re-directing such air flow across the fin surface in such a manner as to increase the heat transfer performance of such fin element without incurring the penalty of higher flow resistance. The present fin elements are generally of a one-piece planar construction and include a plurality of tube openings adaptable for receiving conventional tubular members therethrough. Structurally, the particular pattern of corrugations utilized on the present fin elements provide indentations on one surface of the fin and projections on the opposite fin surface. More particularly, the "dog-bone" type corrugated pattern of the present invention is characterized by a plurality of Y-shaped projections, respective pairs of which are positioned longitudinally between each respective pair of tube openings in opposed relationship to each other such that the V-shaped portion of each Y projection faces and opens toward each respective tube opening on each opposite side thereof. The alternate sides of the corrugated pattern positioned transversely on each opposite side of the respective tube openings are characterized by ridged projections, each projection defining a six-sided corrugation having a depression formed near the center thereof and immediately opposite the respective tube openings, said six-sided projections being preferably integrally formed with the respective leg portions of the adjacent Y projections so as to form an extension thereof. These six-sided projections interconnect the adjacent Y projections and, in combination therewith, form the "dog-bone" shaped corrugations between respective tube openings.

In addition, the V-shaped portion of each Y projection is also positioned so as to be spaced parallel to but non-continuous with the V-shaped portion of the Y projections located about adjacent tube openings. Since the V-portions of the adjacent Y projections are positioned in spaced apart relationship to each other, fluid channels are formed by and between the respective Y projections and around the respective tube openings and these channels effectively interrupt the fluid flow over the surface of the fin and, in effect, cause turbulence and direct such fluid flow around the tubes extending therethrough for maximum heat transfer. The corrugated pattern about each tube opening thus becomes a uniform, discontinuous, six-sided configuration which has the effect of breaking up the fluid flow over the fin surface; it causes fluid flow circulation about the tubes extending therethrough; and it effectively reduces the boundary layer thickness of the fluid flow over the fin surface, the cummulative effects of which result in a fin structure having increased efficiency and increased heat transfer capability as compared to prior art structures, all of which occurs without a corresponding increase in fluid flow resistance across the fin surface. These results have been verified by actual experimentation and it has been shown that use of the present fin elements produces an overall increase in the performance of fin and tube type heat exchangers, as compared to prior art constructions, in the range from approximately 1% to 2%.

The present fin design also includes a circumferential flange or annular collar extending outwardly from each of the tube openings to enhance connection between the tubes and the fin and it may further include folded over side edges as disclosed in co-pending U.S. patent application Ser. No. 378,727, filed May 17, 1982, which application is assigned to the same assignee as this application.

It is therefore a principal object of the present invention to provide a simple fin construction which effectively increases the heat transfer capability of such fin without increasing the resistance to the air flow thereacross.

Another object is to provide an improved fin construction that effectively reduces the thickness of the boundary layer of the fluid medium flowing thereacross and, at the same time, re-directs such flow around and between the tubes extending therethrough for maximum heat transfer capability.

Another object is to provide an improved fin construction utilizing a "dog-bone" type pattern of corrugations to induce turbulent air or other fluid flow across the fin surface and around the tubes extending therethrough.

Another object is to provide an improved fin construction which effectively eliminates the stagnation area immediately downstream of each respective tube extending therethrough and increases the air flow velocity therebehind.

Another object is to provide a relatively simple fin construction which can be economically produced for commercial use.

These and other objects and advantages of the present invention will become apparent to those skilled in the art after considering the following detailed specification of the subject device in conjunction with the accompanying drawings, wherein.

Figure 4:
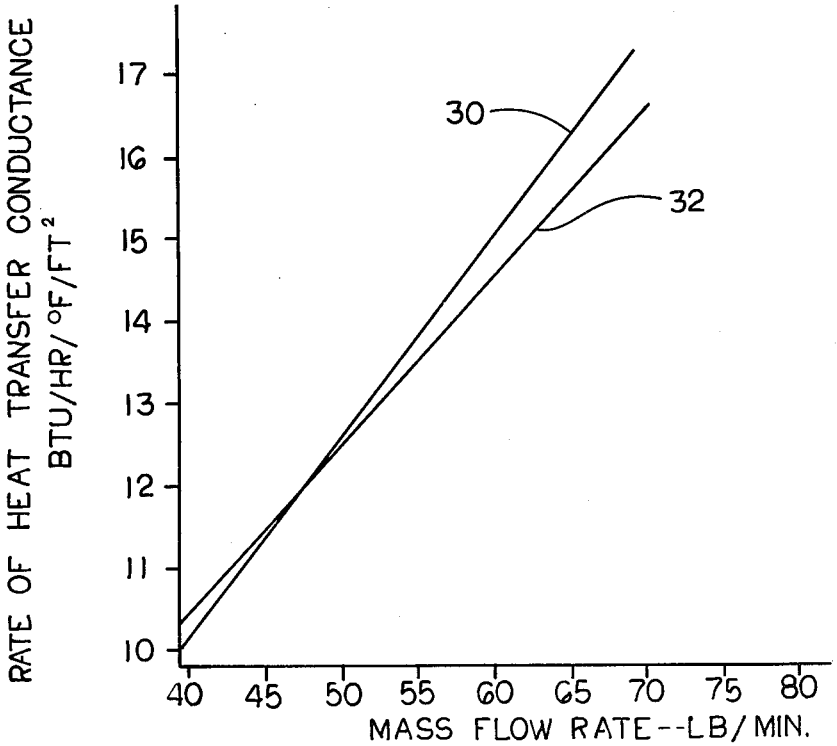

FIG. 4 is a graph comparing the rate of heat transfer conductance between a heat exchanger core assembly utilizing the present fin elements and a core assembly utilizing a diamond configuration prior art fin structure such as disclosed in Lu U.S. Pat. No. 3,515,207.

Figure 1:
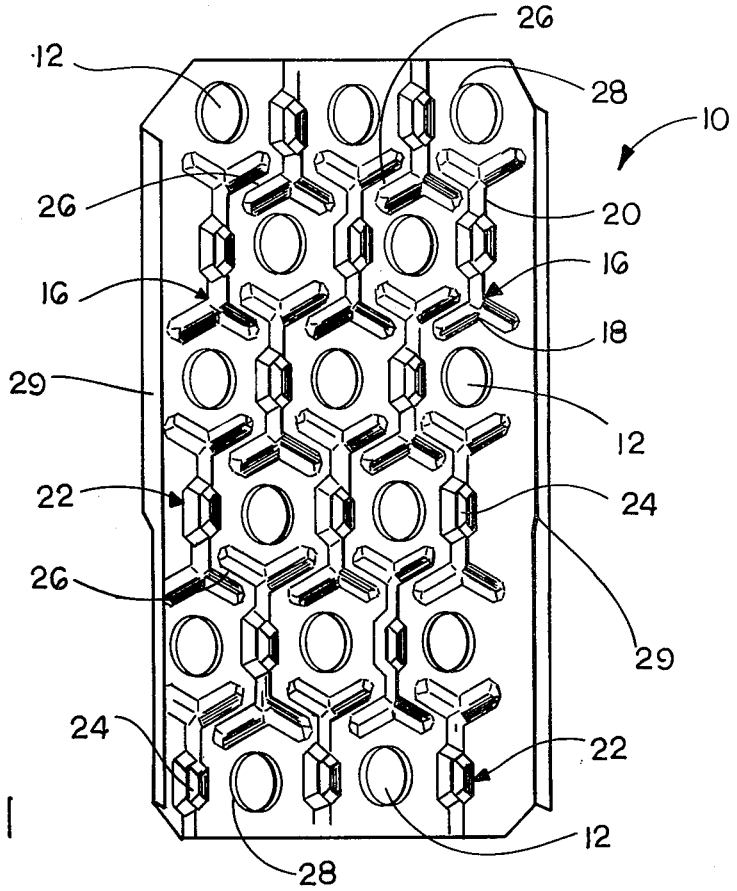
FIG. 1 is a perspective view of a fin element constructed according to the teachings of the present invention.
Figure 3:
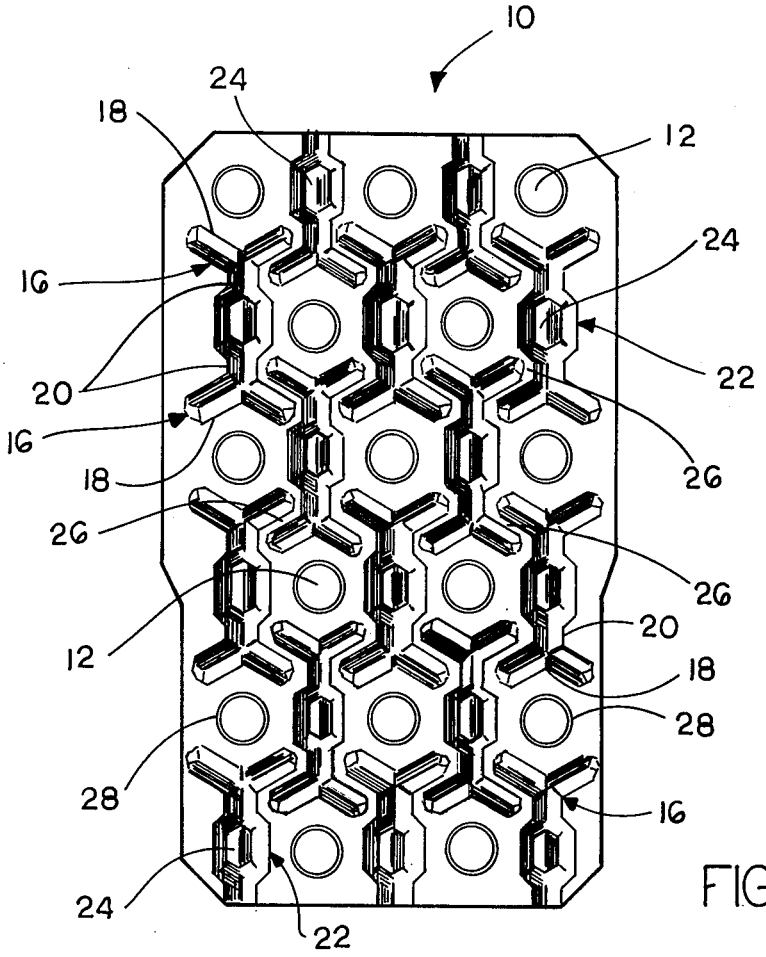
FIG. 3 is a top plan view of the fin element shown in FIGS. 1 and 2.
Figure 2:
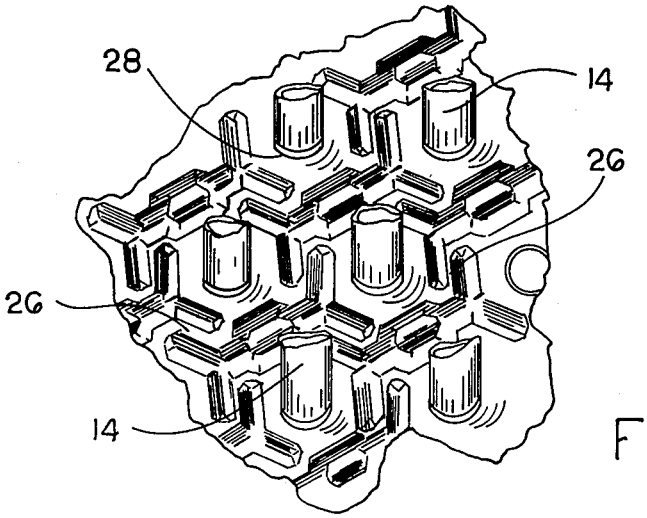
FIG. 2 is a partial perspective view of the fin element of FIG. 1 showing several tubes extending therethrough.

Referring to the drawings more particularly by reference numerals wherein like numerals refer to like parts, number 10 in FIG. 1 illustrates a fin element constructed according to the teachings of the present invention. The fin structure 10 is shown as being substantially rectangular in shape and includes a plurality of openings 12 adaptable for receiving the tubular members 14 therethrough. The fins 10 are generally of a one-piece planar construction and include a particular pattern of corrugations which extend substantially across the entire surface thereof such that, with respect to the air flow over the fin surface and around and past the tubes 14 extending therethrough, each tube 14 is surrounded by a uniform, discontinuous, six-sided configuration as shown in FIGS. 1–3. The corrugated pattern is provided by suitably deforming the fin structure such that the corrugations project from the normal plane surface thereof. Structurally, the corrugations provide indentations on one fin surface and projections from the opposite fin surface.

More specifically, the fin element 10 includes a "dog-bone" type corrugated pattern characterized by a plurality of open Y-shaped projections 16 which are uniformly distributed across and raised above the normal plane surface of the fin 10 as shown in FIGS. 1–3. The Y-shaped projections 16 each include a V-shaped portion 18 which is positioned to face the respective tube openings 12 and a leg portion 20 which extends oppositely therefrom. Respective pairs of the Y-shaped projections 16 are arranged and positioned longitudinally between each respective pair of tube openings 12 in opposed relationship to each other such that the V-shaped portions 18 associated respectively therewith lie adjacent to and open towards each respective tube opening 12 on each opposite side thereof (FIGS. 1–3). The opposite sides of each corrugated pattern positioned transversely on each opposite side of the respective tube openings 12 are characterized by the ridged projections 22, each projection 22 defining a six-sided corrugation having a depression 24 formed near the center thereof and immediately opposite the respective tube openings 12, each six-sided projection 22 being preferably integrally formed with the respective leg portions 20 of the adjacent Y projections 16 so as to form an extension thereof as shown in FIGS. 1–3. The projections 22 interconnect the adjacent opposed Y projections 16 extending longitudinally in opposite directions therefrom, the projections 16 and 22 in combination defining the "dog-bone" shaped corrugations therebetween. The depression 24 will be generally completely closed at the bottom although the bottom may have a narrow slit as a result of the molding process.

In addition, the V-shaped portion 18 of each respective Y projection 16 is positioned and arranged facing the respective tube openings 12 so as to be spaced parallel to but non-continuous with the V-shaped portions of the Y projections located about adjacent tube openings. Since the V-shaped portions 18 of the adjacent Y projections 16 are positioned in spaced apart relationship to each other (FIGS. 1–3), air channels or passageways 26 are formed by and between the respective Y projections. These air channels 26 in combination with the ridges formed by the raised "dog-bone" shaped corrugations interrupt the air flow over the surface of the fin 10 and, in effect, cause turbulence thereacross and the channels 26 actually direct such air flow around and between the tubes 14 extending therethrough (FIG. 2) for achieving maximum heat transfer. The corrugated pattern about each tube 14 thus becomes a uniform, discontinuous, six-sided configuration which has the effect of breaking up the air flow over the fin surface and causing circulation about the tubes 14 for maximum heat transfer.

The "dog-bone" shaped corrugations hereinbefore described are arranged in a very specific manner so as to maintain open air flow channels 26 between the Y-shaped projections 16 in the vicinity of each respective tube opening 12. As previously explained, these air channels serve to initiate and induce turbulence and guide the air flow around the tubes 14 in such a manner as to decrease the boundary layer thickness of the air flowing over the fin surface thereby increasing its heat transfer capability. The particular pattern of corrugations utilized in the present invention specifically channels the air flow in an undulating path across the fin surface and around and between the respective opposite sides of the tubes 14 thereby achieving maximum heat transfer capability.

Each fin element 10 also includes a circumferential flange or annular collar 28 extending outwardly from around each of the openings 12 as shown in FIGS. 1–3. The collars 28 extend in a direction away from the planar surface of the fin and each collar 28 serves as the means for separating and maintaining the required spacing between adjacent fin elements when such fins are stacked one upon the other to form a particular core assembly. During assembly of the core unit, the tube members 14 are positioned through the openings 12 located on the fin element 10 and the plurality of fins 10 are thereafter placed in abutment with each other such that the upper portion of each collar 28 presses against the adjacent fin element. This self-spacing feature is quite common in the industry and use of the collars 28 are highly desirable for controlling the spacing between adjacent fin elements. It is recognized that the height of the individual collars 28 may be varied depending upon the desired spacing. Additionally, each fin element 10 may also include folded over side edges such as the side edges 29 (FIG. 1). The use and application of the folded over side edges 29 are fully explained and disclosed in co-pending U.S. patent application Ser. No. 378,727 filed May 17, 1982, now U.S. Pat. No. 4,428,418.

When a number of fins are assembled to make up a core assembly, the core assembly is comprised of a plurality of tubes 14 which extend through and are bonded to a plurality of spaced apart fin elements 10 so as to achieve a cross-flow pattern of fluid distribution therethrough whereby two fluid media pass through the core assembly in heat exchange relationship with each other. When utilized in a heat exchanger core assembly, the fins 10 are disposed in spaced apart parallel relationship with each other and each pair of fins 10 define a passageway therebetween for allowing a fluid medium such as air to flow therethrough. The fin elements 10 are provided to increase the effect of the heat transfer surface and when a fluid such as air is directed between the fins 10 and over the tubes 14, a transfer of heat occurs between the flowing surface fluid and the fluid medium flowing through the tubes. It should be noted that all of the structural members comprising a typical core assembly, namely, the fin elements 10 and the tubular members 14, are formed of a suitable heat conducting metal such as aluminum, copper, steel and/or copper clad, and such fin and tube members are conventionally joined together by any suitable bonding means such as by soldering, crimping and/or brazing to form the unitized core structure. The specific type of bonding utilized may vary depending upon the particular application of the heat exchanger unit. When so assembled, the corrugation projections on one fin element are positioned so as to oppose the corrugation indentations on an adjacent fin element, and the "dog-bone" shaped corrugations of adjacent fin elements overlie and are substantially in alignment with one another. With this particular arrangement, air flow is confined and channeled between the adjacent fins and the opposed and aligned projections and indentations positively direct and guide the air flow along an undulating path around and between the tubes 14. This produces turbulence to eliminate the stagnation area on the downstream side of each tube 14 and to effectively reduce the boundary layer thickness as aforementioned. Although the present fin structure 10 is shown and described in conjunction with a fin and tube type heat exchanger construction, it is recognized that the present fin devices 10 are easily and conveniently adaptable for use in any heat exchanger core assembly which utilizes fins.

The improved heat transfer performance of the present fin element 10 has been verified by experimentation. FIG. 4 depicts normalized graphs extrapolated from empirical data obtained by actual experimentation. The graph lines compare the rate of heat transfer conductance between a heat exchanger core assembly utilizing the subject fins and a core assembly utilizing a diamond shaped prior art fin structure such as disclosed in Lu U.S. Pat. No. 3,515,207. Heat transfer performance tests conducted on the respective heat exchanger core assemblies, under identical test parameters and under identical operating environments, have yielded the performance curves as shown in FIG. 4. In FIG. 4 are normalized plots of the rate of heat transfer conductance measured in BTU/hour/°F./feet$^2$ as a function of the mass flow rate of the air flow over the fin surface measured in pounds/minute. Graph line 30 is a plot of the rate of heat transfer conductance for a core assembly utilizing the improved fin element 10 having the "dog-bone" type pattern of corrugations extending over substantially the entire fin surface as shown in FIGS. 1–3. Similarly, graph line 32 is a plot of the rate of heat transfer conductance of a similar core assembly utilizing the prior art corrugated fin structure. It should be noted that as the mass flow rate of the air flow over the respective fin surfaces increased above approximately 47.0 pounds/minute, the rate of heat transfer conductance of the subject fin 10 steadily and uniformly increased over that of a known prior art construction. In fact, at a mass flow rate of approximately 70.0 pounds/minute, which mass flow rate is typical in many heat exchanger applications, the heat transfer capability of the present fin 10 exceeded the heat transfer performance of the prior art fin structure by approximately 1% to 2%. In addition, as the mass flow rate of the air flow across the fin surface increases above 70.0 pounds/minute, the heat transfer efficiency of the subject fin 10 as compared to the prior art structure likewise increases. Additionally, flow resistance testing conducted on the same identical heat exchanger core assemblies used to derive the performance curves 30 and 32 also yielded identical flow resistance curves (not shown). This testing substantiated the fact that the present fin element 10 achieves its increased heat transfer performance without a corresponding increase in flow resistance.

The difference in overall heat transfer conductance rates is directly related to the particular pattern of corrugations or other means utilized on the fin surface to induce turbulent flow and to reduce the thickness of the boundary layer associated therewith. During testing, it was noted that the uniform yet discontinuous "dog-bone" pattern of corrugations utilized in the present device 10 sufficiently altered the fin side fluid flow characteristics in such a manner as to enhance the heat transfer performance of the heat exchanger core assembly utilizing this particular fin configuration. In particular, as previously stated, the air channels 26 formed by and between the respective V-shaped portions 18 of adjacent Y projections 16 sufficiently channeled and guided the air flow around the tube openings 12 and the tubes 14 extending therethrough so as to bring the air flow directly into contact with the downstream side of the respective tubes thereby achieving heat transfer from an otherwise lost surface. This prevents the creation of an otherwise stagnant area downstream of the respective tubes and reduces excessive boundary layer thickness which might otherwise occur in this area. The same reduction in boundary layer thickness and overall increase in the rate of heat transfer conductance was not achieved with the prior art fin structure. Thus, it was demonstrated that the particular pattern of corrugations utilized in the present fin element 10 increases the overall heat transfer capability of the fin and tube arrangement shown in FIG. 2 and the present fin 10 does so without adversely effecting air flow over the fin surface and through the core assembly. Hence, use of the present fin element 10 in a heat exchanger core assembly substantially increases the thermal performance of the core assembly and produces a more efficient heat exchanger unit. It is recognized, however, that the rate of heat transfer conductance and the mass flow rates as set forth herein are for illustrative purposes only and will vary somewhat depending upon the uniformity of parameters throughout the entire testing environment. Nevertheless, the overall conclusions remain unchanged that the improved fin element 10 has the advantages of reducing the boundary layer thickness of the air flow over the fin surface and of effectively redirecting and guiding such air flow around and between the tubes extending therethrough so as to increase the heat transfer performance thereof without incurring the penalty of higher flow resistance.

In discussing the present invention, it is to be understood that any number of individual fin elements 10 may be advantageously utilized in a heat exchanger core assembly to form any desired length. This enables the employment of an arrangement of fin elements 10 to suit a particular need and increases the usefulness of the present devices. In addition, it is also recognized that the fin and tube arrangement comprising a typical core assembly is generally supported in a frame or manifold housing which serves to better define a flow path over the individual fin elements. The manifold housing or the like cooperates with other suitable manifolding for directing the two fluid media through their respective flow passageways. Additionally, it is also recognized that the overall size and shape of the individual fin elements 10 may be conveniently fashioned into a variety of sizes and configurations, for example, a triangular, rectangular, hexagonal, circular, or other configuration, so as to be compatible with the size and shape of the manifold housing into which it will be mounted or to conform with any other space limitations without impairing the teachings and practice of the present construction. Although the present fin elements 10 are primarily designed for use in fin and tube type heat exchanger devices, the present fin devices are also easily adaptable for use with any heat exchanger device. The simplicity, durability, flexibility, and versatility of the present fin devices greatly increases its usefulness and effectiveness in a wide variety of heat exchanger applications.

Thus there has been shown and described a novel fin configuration for use in fin and tube type heat exchangers, which fin construction fulfills all of the objects and advantages sought therefor. Many changes, modifications, variations, and other uses and applications of the present construction will, however, become apparent to those skilled in the art after considering this specification and the accompanying drawings, and all such changes, modifications, variations, and other uses and applications which do not depart from the spirit and scope of the invention are deemed to be covered by the invention which is limited only by the claims which follow.

What is claimed is:

1. A heat exchanger core assembly adaptable for allowing the passage of a first fluid medium therethrough comprising a plurality of substantially parallel tubular members extending through said core assembly, a plurality of spaced apart fin elements having a plurality of openings extending therethrough adapted for receiving said tubular members, said tubular members being disposed through said fin openings and adapted for receiving and carrying a second fluid medium therewithin, said fin elements being disposed in a substantially parallel relationship with each other and each pair of said fin elements defining a passageway therebetween for allowing said first fluid medium to flow therethrough, each of said fin elements having oppositely facing surfaces associated therewith and each including a uniform discontinuous corrugated surface pattern extending in surrounding relationship around each of said tubular members, each of said corrugated patterns being displaced from the general plane of said fin elements so as to form a discontinuous six-sided shaped indentation around each of said tubular members on one of said fin surfaces and a corresponding discontinuous six-sided shaped projection around each of said tubular members on the other of said fin surfaces, each respective side of said six-sided shaped indentations and projections extending in a non-radial pattern around each of said tubular members, said corrugated surface patterns operatively directing at least a portion of the first fluid medium over said fin elements and around said tubular members to the downstream side of said tubular members.

2. The heat exchanger core assembly defined in claim 1 wherein said fin elements include means extending from at least one surface thereof for maintaining the required spacing between adjacent fin elements.

3. The heat exchanger core assembly defined in claim 1 wherein the six-sided shaped indentations formed on one fin element are positioned in opposed relationship to the six-sided shaped projections formed on an adjacent fin element, the indentations and projections associated with adjacent fin elements being positioned in relative alignment with each other.

4. An improved fin element adaptable for use in a fin and tube type heat exchanger, said heat exchanger being adaptable for fluid flow in a given direction therethrough, said fin element comprising a generally planar member having oppositely facing surfaces associated therewith and a plurality of tube openings extending therethrough, each of said tube openings being adaptable for receiving a tubular member therethrough, said fin elements including a plurality of dog-bone shaped corrugations extending substantially over its planar surfaces, each of said dog-bone shaped corrugations being positioned longitudinally between respective pairs of said tube openings and each being displaced from the general plane of said fin element such that indentations are formed on one of said fin surfaces and corresponding projections are formed on the other of said fin surfaces, said dog-bone shaped corrugations being positioned in spaced apart relationship parallel to but non-continuous with adjacent dog-bone shaped corrugations located about adjacent tube openings, said spaced apart dog-bone shaped corrugations forming channels therebetween adaptable for operatively directing at least a portion of the fluid flow across said fin element and around said tube openings.

5. The fin element defined in claim 4 wherein said fin element is generally rectangular in shape and is formed of a suitable heat conducting material.

6. The fin element defined in claim 4 wherein said fin element includes means on at least one surface thereof for providing spacing between itself and a similarly constructed fin element positioned adjacent thereto.

7. The fin element defined in claim 6 wherein said means for providing spacing between adjacent fin elements includes a circumferential flange extending around the plurality of tube openings associated with each of said fin elements.

* * * * *